US006209440B1

(12) United States Patent
Dannehl et al.

(10) Patent No.: US 6,209,440 B1
(45) Date of Patent: Apr. 3, 2001

(54) HYDRAULIC DOUBLE TELESCOPIC PROP

(75) Inventors: Friedrich Wilhelm Dannehl, Hagen; Werner Reinelt, Bochum, both of (DE)

(73) Assignee: DBT Deutsche-Bergbau Technik GmbH, Lunen (DE)

( * ) Notice: Subject to any disclaimer, the term of this patent is extended or adjusted under 35 U.S.C. 154(b) by 0 days.

(21) Appl. No.: 09/284,328

(22) PCT Filed: Nov. 8, 1997

(86) PCT No.: PCT/DE97/02656

§ 371 Date: Apr. 12, 1999

§ 102(e) Date: Apr. 12, 1999

(87) PCT Pub. No.: WO98/22695

PCT Pub. Date: Mar. 28, 1998

(30) Foreign Application Priority Data

Nov. 20, 1996 (DE) ..... 196 47 943

(51) Int. Cl.[7] ..... F01B 7/20
(52) U.S. Cl. ..... 91/168; 91/170 MP; 92/52
(58) Field of Search ..... 91/167 R, 168, 91/170 MP, 173; 92/52

(56) References Cited

U.S. PATENT DOCUMENTS 1,963,286 * 6/1934 Ballert ..... 91/168
3,241,801 3/1966 Wilkenloh .
3,696,712 * 10/1972 Sung ..... 92/52
4,523,512 * 6/1985 Hessel et al. ..... 91/168

FOREIGN PATENT DOCUMENTS 1 149 678 6/1963 (DE) .
1 207 307 12/1965 (DE) .
33 25 746 4/1985 (DE) .
WO 92/01858 2/1992 (EP) .

* cited by examiner

*Primary Examiner*—F. Daniel Lopez
(74) *Attorney, Agent, or Firm*—Vickers, Daniels & Young

(57) ABSTRACT

The double telescopic prop comprises an outer cylindrical casing tube 1, an inner tube 2 which is displaceable therein and a piston rod 3 which can be extended therefrom. The hydraulic fluid for extending the two prop stages is conveyed through a connection 14 to the piston 5 of the inner tube 2 and is conveyed via a bottom valve to the piston 7 of the piston rod 3. The prop is retracted if hydraulic fluid flows via the connection 17 into the outer annulus 11 between the cylindrical casing tube 1 and the inner tube 2. A size ratio of 8.8:1 at most, which is favourable for the retraction of the prop, exists between the area of the inner tube 2 and the ring area of the annulus 11.

2 Claims, 1 Drawing Sheet

HYDRAULIC DOUBLE TELESCOPIC PROP

DESCRIPTION

Figure 1:
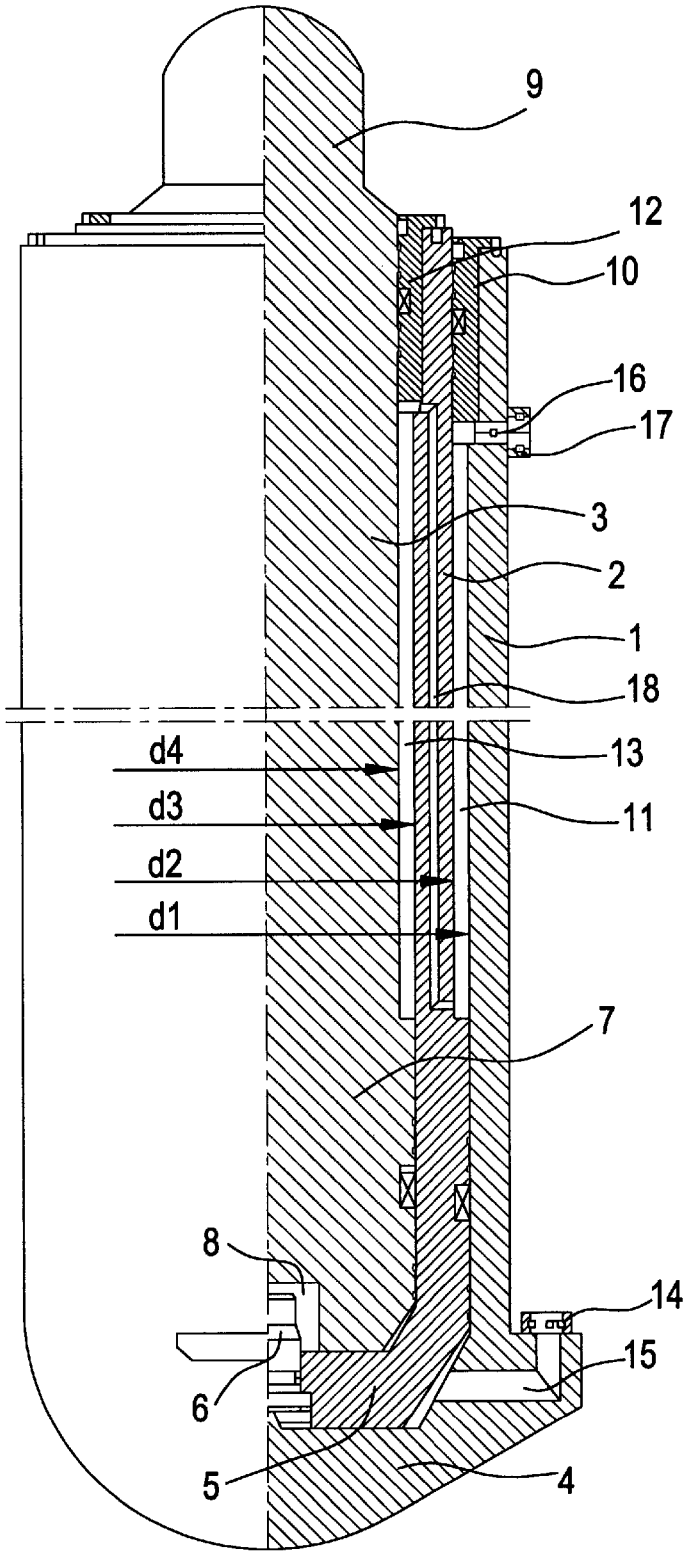

A hydraulic double telescopic prop comprising an outer cylindrical casing tube, an inner tube which is displaceable therein and a piston rod which can be extended therefrom, having an outer annulus between the cylindrical casing tube and the inner tube and having an inner annulus between the inner tube and the piston rod, wherein the pressure medium can be fed under a piston of the inner tube and via a bottom valve under the piston rod in order to extend the two pressure stages, and can be fed into the outer and inner annuli for retraction.

Two-stage double telescopic props of the aforementioned type are used underground in mining in combination with hydraulic self-advancing supports. In order to support the exposed overlying stratum in a longwall face with a high shaft lining supporting force during the mining of coal, props of large volume are required, with a correspondingly high requirement for pressure medium. The construction of the props for static loading purposes is fashioned in accordance with the requirements imposed, and the prop tubes and piston rod are designed with suitable cross-sections and wall thicknesses. In turn, the dimensions selected have an effect on the sizing of the nominal diameters of the control valves and of the supply lines containing hydraulic fluid. These relationships ultimately determine the properties of a prop, which apart from the supporting force of the prop also include its drawing-in properties, which are important for shifting the wall lining during the reverse operation. For drawing-in, i.e. for retracting the placed prop, the pressure space in the outer cylindrical casing tube is connected to the return line to the tank, so that hydraulic fluid can drain off and the prop can sink. Hydraulic fluid is at the same time introduced into the outer annulus between the cylindrical casing tube and the inner tube. This hydraulic fluid acts on the ring area on the piston of the inner tube and pushes it in. The force which is generated on the small pressurised ring area for drawing-in the prop is slight, however. In contrast, a resistance to flow occurs in the control valve when the hydraulic fluid is expelled from the prop space of large volume, and moreover this resistance to flow is increased by a banking-up pressure in the return line if hydraulic fluid simultaneously flows into the return line from other consumers of hydraulic fluid.

The consequence is a slow sinking-in of the prop and a delay in the progress shaft lining shifting operation. A structural enlargement of the ring area would inevitably increase the external dimensions of the prop or would impair the static loading properties of the prop if it were carried out at the expense of the internal dimensions of the prop. Both of these effects are undesirable.

The present invention stems from background art from internal operations. According to this, hydraulic double telescopic props are constructed in such a way that the outer annulus between the cylindrical casing tube and the inner tube, which annulus is acted upon by hydraulic fluid during the drawing-in operation, has a relatively narrow aperture width, so that a size ratio of at least 10:1, which is unfavourable as regards the sinking-in behaviour of the prop, is achieved between the piston area of the inner tube and the ring area. On the other hand, the smaller size ratio of the inner ring area to the piston rod area remains unutilised, because the piston rod is generally not retracted during a shaft lining shifting operation.

The underlying object of the present invention is to fashion the static loading construction of a telescopic prop of the type cited at the outset, whilst retaining its external dimensions, in such a way that the force available for drawing-in is increased whilst the supporting force remains constant.

The double telescopic prop exhibits an advantageous relation of its dimensions to the form of the inner prop construction, in order to increase the ring area over the piston of the inner tube whilst the predetermined external dimensions and supporting forces remain unchanged, and in order to intensify the force for drawing-in the prop.

Since neither the requisite wall thicknesses of the prop tubes nor the piston rod diameter are changed, the static loading construction of the prop remains unchanged. The greater force is utilised for speeding up the drawing-in process, because at the higher liquid pressure a larger amount of liquid can also flow out of the pressure space of the prop into the return line. This saving in time when drawing in the prop speeds up the shaft lining shifting operation. There is thus an avoidance of delays in shaft lining such as those which occur in modern high output operations when a mining machine with a high cutting speed rushes ahead of the shifting of the shaft lining, because the shifting operation requires more time than does the mining of coal, so that the shaft lining remains behind.

The invention is explained in more detail below with reference to an example of an embodiment which is illustrated in the drawing. The drawing shows a hydraulic double telescopic prop in its retracted or drawn-in state, the right half of which is illustrated in longitudinal section.

The prop is of two-stage construction, and comprises an outer cylindrical casing tube 1, an inner cylindrical tube, the inner tube 2 and a piston rod 3, wherein the inner tube 2 is axially displaceably guided in the cylindrical casing tube 1 and the piston rod 3 is axially displaceably guided in the inner tube 2. The bearing of the prop on the footwall side is formed by a hemispherical prop base 4, which terminates the cylindrical casing tube 1 at the bottom. The inner tube 2 is terminated on the footwall side by an inner tube piston 5 of larger diameter with a stepped reduction, in which piston a bottom valve 6 is inserted. The footwall end of the piston rod 3 is likewise of larger diameter than its shank, with a stepped reduction, and is constructed as a piston 7, a recess 8 in which encompasses the protruding part of the bottom valve 6. A prop head 9 is situated at the top end of the piston rod 3.

At its footwall end, the inner tube 2 is guided with its inner tube piston 5 on the inner wall of the cylindrical casino tube 1, and at its head end it is guided in a flange-like threaded ring 10 on the outer wall, which threaded ring is screwed into the cylindrical casing tube 1 from above. An outer annulus 11 with an aperture width $d_1-d_2$ is thus formed between the inner wall of the cylindrical casing tube 1 of diameter $d_1$ and the outer wall of the inner tube 2 of diameter $d_2$.

In the same manner, the piston rod 3, which slides with its piston 7 on the inner wall of the inner tube 2—diameter $d_3$—is guided by a threaded ring 12 which is inserted in the top end of the inner tube 2. The diameter of the shank of the piston rod 3 is denoted by $d_4$. The inner annulus 13 of aperture width $d_3-d_4$ is formed between the inner tube 2 and the piston rod 3.

The hydraulic fluid is conveyed under the inner tube piston 5, from a connection 14 and via a bore 15, into the lower stage of the prop, whereupon the pressure space, which is not marked, in the interior of the cylindrical casing tube 1 is filled, so that the inner tube 2 moves out until the inner tube piston 5 comes into contact with the threaded ring 10. The hydraulic fluid continues to flow via the bottom valve 6 into the pressure space, which is likewise not marked, in the inner tube 2 of the upper stage, so that the piston rod 3 is also pushed out until the piston 7 comes into contact with the threaded ring 12. The bottom valve 6 is a non-return valve which separates the pressure spaces of the lower stage and of the upper stage from each other. Consequently, a higher pressure can build up in the upper stage than in the lower stage, due to the different area ratios.

Whilst the inner tube is moving out during the placement operation, hydraulic fluid is displaced by the inner tube piston 5 from annulus 11 into the return line, via the bore 16 and the connection 17. Annulus 11 is connected to annulus 13 by a channel 18 which extends in the wall of the inner tube 2, so that the hydraulic fluid can emerge from annulus 13 when the piston rod 3 is extended.

In order to retract the pressure stages during a drawing-in operation, hydraulic fluid is introduced into the outer annulus 11 in the opposite direction through the connection 17. The hydraulic fluid acts on the inner tube piston 5 over the ring area of aperture width $d_1-d_2$, so that the inner tube 2, together with the piston rod 3, is pushed into the pressure space of the cylindrical casing tube 1, from which the hydraulic fluid emerges into the return line via the connection 14. The upper stage is not depressurised at first, because the hydraulic fluid cannot flow out of the pressure space in the inner tube 2 through the closed bottom valve 6.

The bottom valve 6 is not pushed open until the inner tube piston 5 of the inner tube 2 comes into contact with the prop base 4. Hydraulic fluid then flows into the inner annulus 13 via connection 14 and channel 18, and acts on the piston 7 over the ring area of aperture width $d_3-d_4$, so that the piston rod 3 is pushed into the pressure space of the upper stage.

According to the invention, the aperture width $d_1-d_2$ of the outer annulus 11 is greater than or equal to the aperture width $d_3-d_4$ of the inner annulus 13. The wall thicknesses of the outer cylindrical casing tube 1 and of the inner tube 2 are likewise approximately the same.

The piston area $$\left(\frac{d_1}{2}\right)^2 \cdot \pi$$

of the inner tube 2 and the ring area $$\left(\frac{d_1}{2}\right)^2 \cdot \pi - \left(\frac{d_2}{2}\right)^2 \cdot \pi$$

of the outer annulus 11 are in a size ratio of less than or equal to 8.5 to each other.

The piston area $$\left(\frac{d_3}{2}\right)^2 \cdot \pi$$

of the piston area rod 3 and the ring area $$\left(\frac{d_3}{2}\right)^2 \cdot \pi - \left(\frac{d_4}{2}\right)^2 \cdot \pi$$

of the outer annulus 11 are in a size ratio of greater than or equal to 5.51 to each other.

What is claimed is:

1. A hydraulic double telescopic prop comprising an outer cylindrical casing tube, an inner tube which is displaceable therein and a piston rod which is selectively extended therefrom, having an outer annulus between the cylindrical casing tube and the inner tube and having an inner annulus between the inner tube and the piston rod, wherein the pressure medium is selectively fed under a piston of the inner tube and via a bottom valve under the piston rod in order to extend the two pressure stages, and is selectively fed into the outer and inner annuli for retraction, characterised in that an aperture width ($d_1-d_2$) of the outer annulus (11) is designed so that it is greater than or equal to an aperture width ($d_3-d_4$) of the inner annulus (13), and a size ratio of a piston area on the inner tube (2) to a ring area of the outer annulus (13) is less than or equal to 8.5:1, whilst a size ratio of a piston area on the piston rod (3) to a ring area of the inner annulus (13) is greater than or equal to 5.5:1.

2. A hydraulic double telescopic prop according to claim 1, characterised in that the outer cylindrical casing tube (1) and the inner tube (2) have approximately the same wall thicknesses.

* * * * *